United States Patent [19]

Rudy et al.

[11] Patent Number: 4,565,416

[45] Date of Patent: Jan. 21, 1986

[54] LATCHING MEANS AND LOCKING MEANS FOR RETAINING TERMINALS IN A CONNECTOR

[75] Inventors: William J. Rudy, Annville; Dennis E. Smith, Hershey, both of Pa.

[73] Assignee: AMP Incorporated, Harrisburg, Pa.

[21] Appl. No.: 599,092

[22] Filed: Apr. 11, 1984

[51] Int. Cl.[4] ..... H01R 11/11

[52] U.S. Cl. ..... 339/59 M; 339/63 M; 339/196 M; 339/217 S

[58] Field of Search ..... 339/59, 62, 63, 196 R, 339/196 M, 206 R, 206 P, 210 R, 210 M, 217 R, 217 S, 217 PS, 221 R, 221 M

[56] References Cited

U.S. PATENT DOCUMENTS

| | | | |
|---|---|---|---|
| 3,430,185 | 10/1967 | Sitzler et al. | 339/59 |
| 3,487,355 | 12/1967 | Cairns | 339/176 |
| 3,601,760 | 3/1969 | Cairns | 339/59 |
| 3,686,619 | 8/1972 | McCardell, Jr. et al. | 339/59 M |
| 3,937,545 | 2/1976 | Cairns et al. | 339/60 R |
| 4,066,325 | 1/1978 | Pearce, Jr. et al. | 339/176 |
| 4,080,041 | 3/1978 | Hawkins, Jr. | 339/196 M |

FOREIGN PATENT DOCUMENTS

| | | |
|---|---|---|
| 57-192076 | 12/1982 | Japan . |
| 36860 | 10/1984 | Japan . |

*Primary Examiner*—Gil Weidenfeld
*Assistant Examiner*—Paula A. Austin
*Attorney, Agent, or Firm*—Anton P. Ness

[57] ABSTRACT

A housing for an electrical connector is provided having one or more terminal-receiving cavities having wall portions which resiliently expand when a terminal is inserted therein and return to an unexpanded condition when the terminal is latchingly secured therein. Preferably the expandable wall portions comprise two arcuate arm-like sections. An opening is provided between the cavities from a front (or rear) surface of the housing. A locking insert is provided that is inserted into the opening from the front (or rear) surface after the terminals are secured and the cavity walls are unexpanded, filling the opening such that the cavity walls cannot expand and the terminals become dislodged when the locking insert is in place. The locking insert is preferably latchingly secured in the housing and can be removed, if desired.

19 Claims, 6 Drawing Figures

66
62
64
66
60
70
76
2
2
4
4
74
74
52
50
32
30
72
10
10
12
22
18
20
14

LATCHING MEANS AND LOCKING MEANS FOR RETAINING TERMINALS IN A CONNECTOR

FIELD OF THE INVENTION

This invention relates to the field of electrical connectors, and more particularly to dielectric housings having electrical contact terminals secured in cavities therein for mating engagement with a corresponding housing containing mating terminals.

BACKGROUND OF THE INVENTION

Various means are known to secure terminals inside of cavities of a housing. These include the use of potting compound, spring clips and the like. Especially in a multi-terminal housing it is important that all terminals be held securely and in accurate alignment during assembly and handling of the housing and during mating with a corresponding housing which may involve significant insertion force, to maintain the precise alignment of many terminals with their counterpart terminals. Such concerns are also important during in-service use of the housing and during disengagement of one housing from the other when a terminal therein may be subjected to tensile force or tugging and possibly become dislodged from or loosened within its cavity.

It is desirable to have a means to assure that the terminals are properly secured within their respective cavities, and further that they remain properly secured after assembly. It is also desirable to do this in a way which permits disassembly for removal and replacement of terminal, for instance. Further, it is desirable to do this in an economical manner.

U.S. Pat. No. 3,487,355 discloses one method which involves, in a housing having two rows of several cavities containing terminals therein, inserting a long, thin rectangular member from a side of the housing and between the two rows of terminals such that the side edges of the insert member project into recesses on the terminals to hold them in place. U.S. Pat. No. 3,601,760 discloses mating plug and female housings each with two rows of cavities containing terminals which cavities have flexible walls with locating tabs which enter annular recesses of the terminals to position and hold the terminals, and a long, thin rectangular member is then inserted from a side of the housing assembly into an opening between the cavities to prevent free flexing of the walls while it locks the plug and female housings and the pin and socket terminals together.

SUMMARY OF THE INVENTION

According to the present invention a multi-terminal connector housing has terminal-receiving cavities with expandable wall portions having terminal-latching ledges. When a terminal is inserted into its cavity, a circumferential stop shoulder of the terminal pushes the expandable wall portions of the cavity outward until the terminal-latching ledges ride over the stop shoulder; when the ledges enter the latching seat of the terminal adjacent and past the stop shoulder, the expandable wall portions of the cavity return to their normal unexpanded condition and latchingly secure the terminal therein. The expandable wall portions are joined integrally with rigid wall portions of each cavity longitudinally therealong. Of each cavity, its expandable wall portion preferably comprises two arcuate arm-like wall sections extending circumferentially around the cavity from the rigid wall portions and have free ends which meet or almost meet at a point angularly opposite from the rigid wall portion.

According to another aspect of the present invention, a nonresilient locking insert is provided to be inserted into an open area of the housing between the expandable wall portions of the terminal-receiving cavities, which insert has a shape conforming closely to the shape of the open area and prevents the expandable wall portions from re-expanding and allowing a terminal to become disengaged from the housing.

According to still another aspect of the present invention the locking insert may have latching members to latch into latching slots in said connector housing when said locking insert has been fully inserted into a locking position. Such latching members may be disengaged when desired for easy removal of said locking insert in order to then remove one or more contact terminals from said housing.

DETAILED DESCRIPTION OF THE PREFERRED EMBODIMENT

Figure 2:
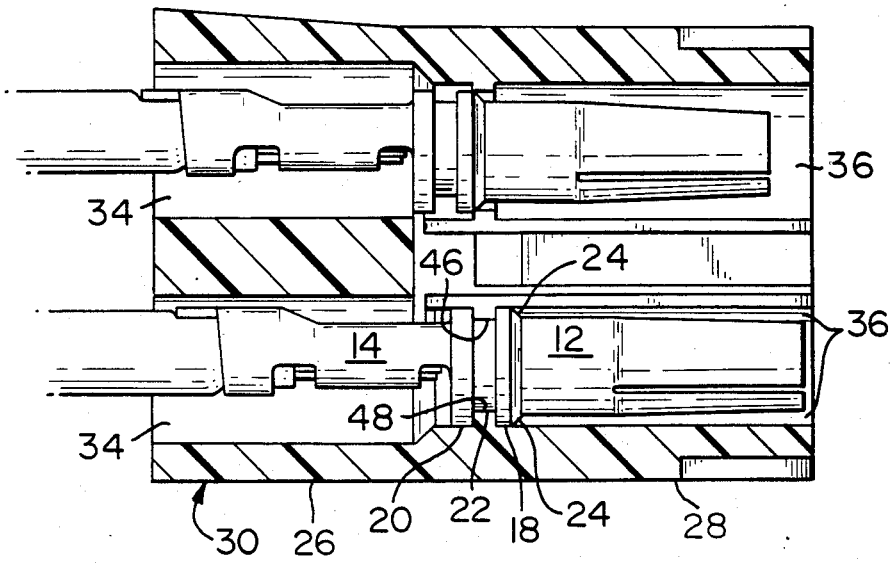
FIG. 2 is a longitudinal section along line 2—2 of FIG. 1 showing one terminal fully inserted and one terminal almost fully inserted.

According to the present invention, a multi-terminal electrical connector has a housing 30 of resilient dielectric material having cylindrical terminal-receiving cavities 32 therein into which cylindrical terminals 10 are to be securably inserted, extending axially therethrough in axial communication with a front surface and a rear surface of the housing. After the terminals are secured, housing 30 is to be engaged in a conventional manner with another housing (not shown) containing mating terminals which other housing may or may not be a housing of the present invention. Housing 30 has a rear portion 26 and a forward portion 28. As best shown in FIG. 2, each of the terminal-receiving cavities 32 of the housing of the present invention has a rear section 34 disposed within a rear portion 26 of housing 30 and larger in diameter than its associated terminal 10 into which the terminal is first inserted during assembly, and a forward section 36 disposed within forward portion 28 of housing 30 and being generally just large enough in diameter to accommodate the widest portions (the stop shoulders 18 and 20) of the terminal. Terminals 10 may be of the socket type, as shown, or the pin type.

Forward cavity section 36 contains terminal-engaging latching means and terminal 10 has cooperating latching means. In the preferred embodiment, the latching means comprises latching ledges 46 and 48 which are to latch into a circumferential latching seat 22 on said terminal intermediate the contact portion 12 and the conductor-securing portion 14 of the terminal 10 when said terminal 10 is fully inserted into the terminal-receiving cavity 32. Optionally, potting compound may be placed in rear sections 34 to secure the conductor-securing portions 14 of the terminals therein.

Figure 3:
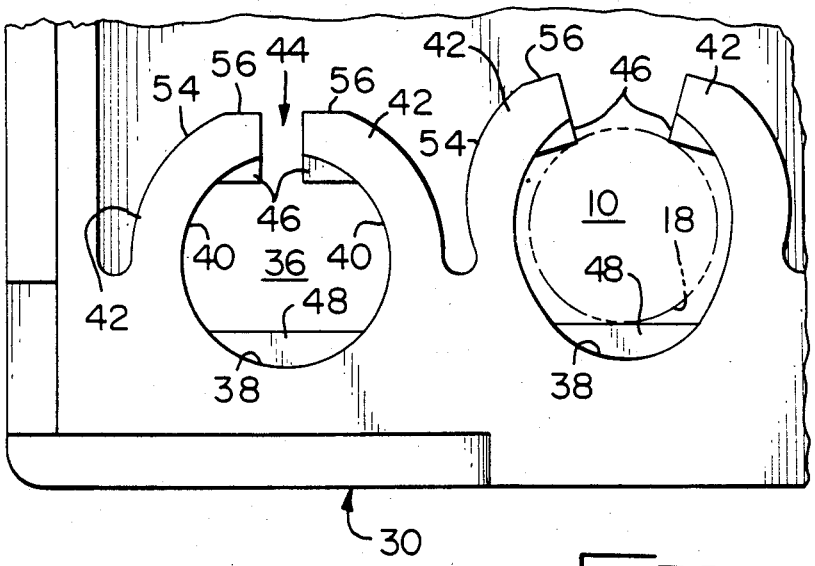
FIG. 3 is a part front view of the housing showing an empty cavity and a cavity with a terminal almost fully inserted.

Referring to FIG. 3, the forward section 36 of each terminal-receiving cavity 32 has a rigid wall portion 38 and an expandable wall portion 40. Rigid wall portion 38 consists of a semicircular groove in a main body of housing 30, shown in this embodiment as the outer wall of housing 30 but which need not be an outer housing wall in order to practice the present invention. Extending inward from outer rigid wall portion 38 and continuing the circular shape of the cavity cross section is the inner expandable wall portion 40, preferably comprised of arcuate arm-like wall sections 42. The free ends of arm-like wall sections 42 meet or almost meet at separation or gap 44 angularly opposed from rigid wall portion 38, and have a thickness and are of such material to have enough resilience to be expanded apart when a terminal 10 is being inserted, but have enough strength to return to their unexpanded condition when the terminal 10 has been fully inserted and latching ledges 46 and 48 have latched into circumferential latching seat 22 on the terminal. Arm-like wall sections 42 are preferably joined integrally with rigid wall portion 38 longitudinally therealong but are not joined to rear portion 26 of housing 30 so as not to interfere with expansion.

Latching ledges 46 and 48 preferably are not circumferential around the cavity but, as shown in FIG. 3, are chordal, parallel and aligned with each other, and in the same transverse plane. Inner latching ledge 46 is in two parts separated by gap 44, each part located on an arm-like wall section 42, which two parts are aligned when the arm-like wall sections 42 are unexpanded; outer latching ledge 48 is located on outer wall portion 38. Inner and outer latching ledges 46 and 48 respectively are spaced from each other a distance equal to (or only slightly greater than) the diameter of latching seat 22 of terminal 10 so that the latching ledges can completely enter latching seat 22 and latchingly secure terminal 10 and allow arm-like wall sections 42 to return fully to their unexpanded condition. Seen best in FIG. 2, the forward portion of forward stop shoulder 18 of terminal 10 has a beveled surface 24. As terminal 10 is inserted into the forward section 36 of terminal-receiving cavity 32, beveled surface 24 engages latching ledges 46 and 48 approximately simultaneously. As terminal 10 continues forward, and because outer latching ledge 48 is located on a rigid outer wall portion 38, terminal 10 is urged laterally away from outer wall portion 38 and against both parts of inner ledge 36 on arm-like wall sections 42 forcing free ends of sections 42 further away from outer wall portion 38 and away from each other at gap 44, thus expanding inner expandable wall portion 40 radially outwardly.

Figure 1:
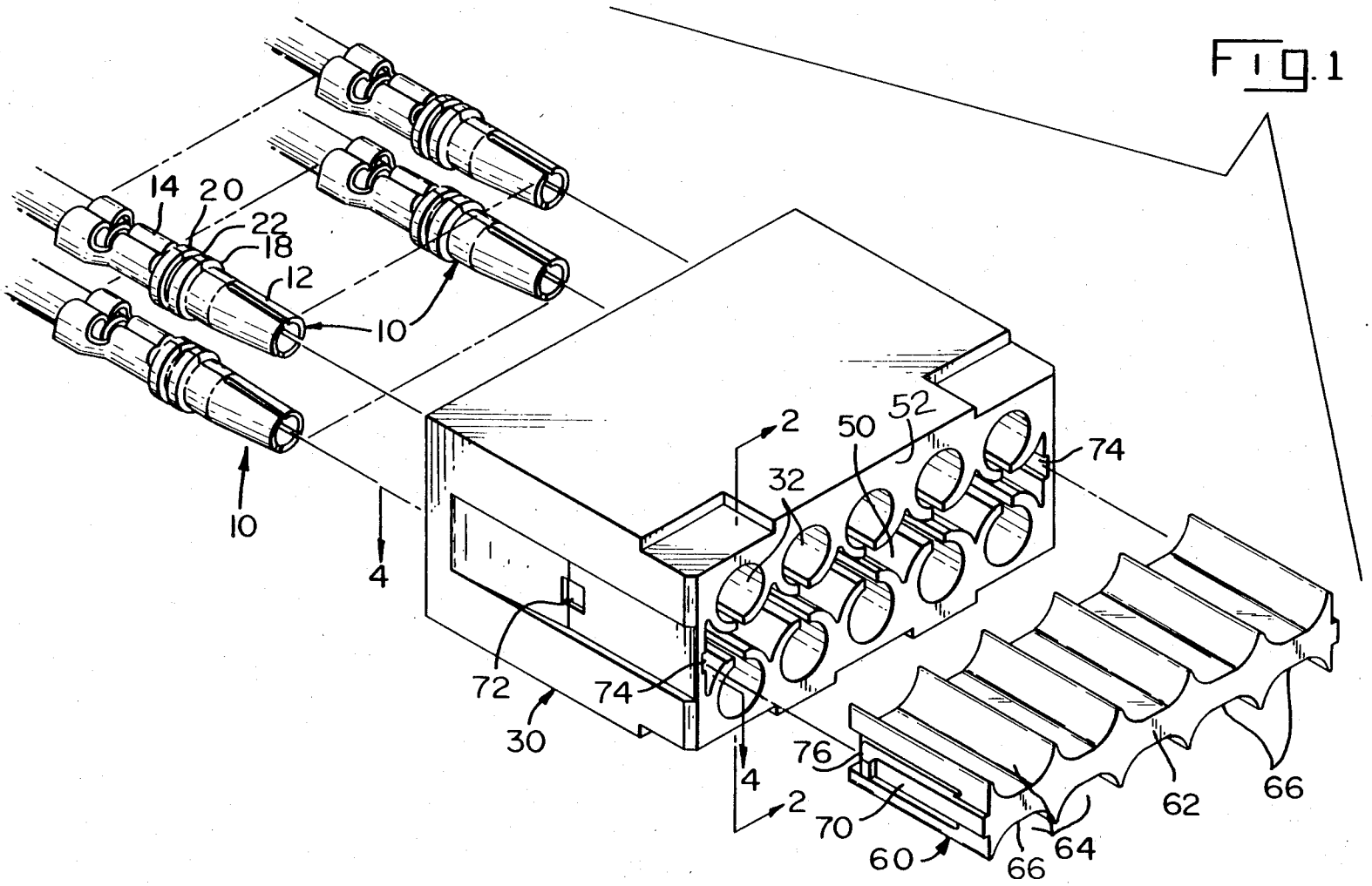
FIG. 1 is an exploded view of the housing, locking insert and terminals prior to assembly.

When the latching ledges 46 and 48 are latched in seat 22 of terminal 10 and all such terminals are latched thus, locking insert 60 can be inserted into inter-cavity opening 50, preferably entering from the front surface 52 of the housing 30, as seen in FIG. 1. Locking insert 60 has a shape conforming closely to that of the inter-cavity opening 50 and extending into housing 30 the full length of the forward sections 36 of terminal-receiving cavities 32.

Preferably, locking insert 60 is comprised of a body section 62, with locking channels 64 in body section 62 which, upon insertion of locking insert 60 into inter-cavity opening 50 of housing 30, will engage outer surfaces 54 of terminal-receiving cavities 32 and prevent arm-like wall sections 42 from being expanded outward to unlatch from terminal 10. Preferably arm-like wall sections 42 have flat surfaces 56 on outer surfaces 54 which are aligned with each other when arm-like wall sections are in their unexpanded condition. Locking channels 64 have corresponding flat surfaces 66 which conform to flat surfaces 56. The configuration of the remaining portions of outer surfaces 54 is preferably arcuate, and likewise the configuration of the corresponding remaining portions of locking channels 64. As can be seen in FIG. 1, locking insert 60 thus has a cross-sectional shape which conforms closely to the cross-sectional shape of inter-cavity opening 50. However, locking insert 60 may have a simplified rectangular shape with a thickness approximately equal to the distance between flat surfaces 56 of opposing cavity walls and still function to lock said terminals in their respective cavities, all within the scope of the present invention.

Optionally, the front of locking insert 60 may have beveled surfaces (not shown) to assist in insertion into inter-cavity opening 50 of housing 30.

Figure 4:
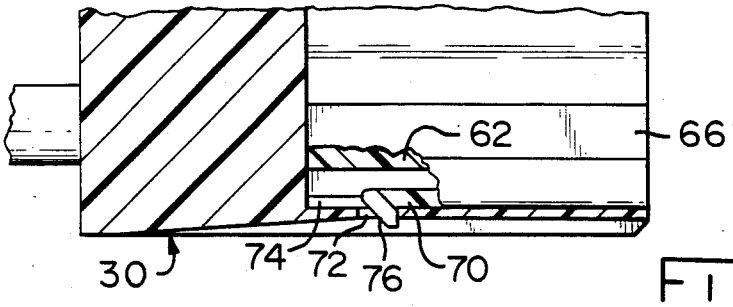
FIG. 4 is a part section along line 4—4 of FIG. 1 showing the locking insert in latching engagement with the housing.

It is preferred that locking insert 60 has latching means so that it may latch into cooperating latching means of housing 30 when fully inserted, and so that it may be unlatched therefrom and removed from housing 30 when desired, in order to then remove one or more terminals 10 from housing 30. Preferably, latching members 70, such as the cantilever spring arms shown is FIG. 1, are provided on locking insert 60 which, as seen in FIG. 4, will latch into latching slots 72 of housing 30. Latching members are easily accessible from the outside of housing 30 in order to be manually (or by means of a tool) dislodged from slots 72 and thus allow locking insert 60 to be removed. Other latching means may optionally be used with the locking insert of the present invention.

Figure 5:
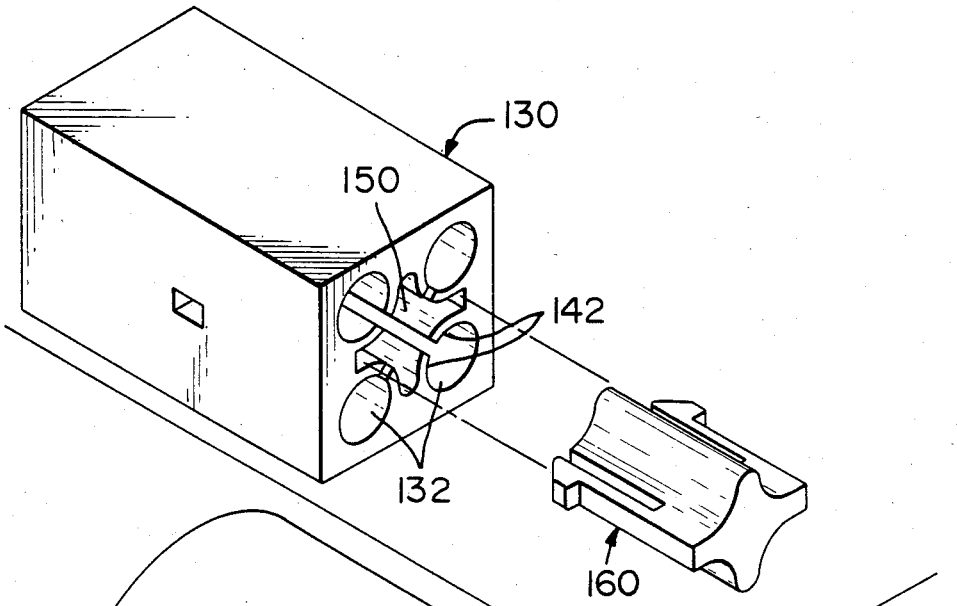
FIG. 5 is an alternate embodiment of the invention.

FIG. 1 illustrates a housing 30 having two rows of five terminal-receiving cavities 32 for receiving ten terminals therein. The present invention may be used with housings receiving different numbers of terminals, and having somewhat different arrangements. As can be seen in FIG. 5, a rectangular housing 130 has four terminal-receiving cavities 132 with expanding wall sections 142 expandable into inter-cavity opening 150, and a corresponding locking insert 160 can be used therewith.

Figure 6:
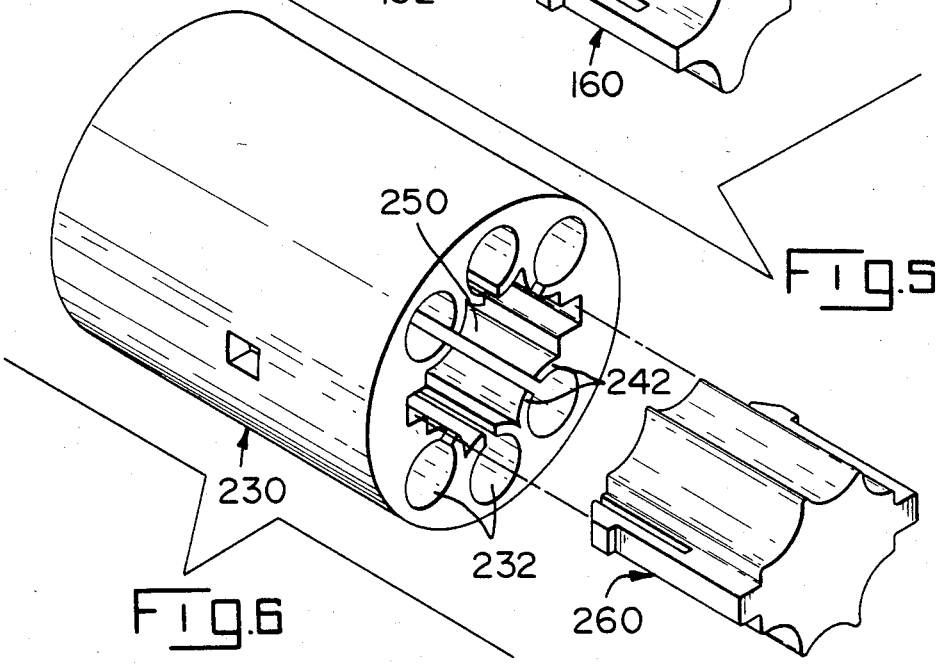
FIG. 6 is an alternate embodiment of the invention.

FIG. 6 illustrates another embodiment of the present invention, a circular housing 230 having six terminal-receiving cavities 232 with expanding wall sections 242 expandable into inter-cavity opening 250, and a corresponding locking insert 260 for use therewith.

In any of the embodiments, the housings may be selectively loaded if desired; that is, not all of the cavities need have terminals therein in order to practice the invention. It is also within the scope of the invention for the expandable wall to be used in a housing having only a single terminal-receiving cavity for use with only a single terminal therein. If a locking insert is to be used therewith, an opening for the insert may be provided within outer walls of the housing, and the expandable wall portion of the single cavity be expandable into the opening.

It is preferred that the expanding wall sections in a multi-terminal housing be arranged to be expandable into a common inter-cavity opening centralized with respect to the cavities in order to keep the shape of the locking insert rather simplified. The inter-cavity opening should allow for at least one and preferably two opposed latching members on the locking insert to latch into latching slots accessible from outside of the housing. Further, it is preferred to have grooves 74 in housing 30, as seen in FIG. 1, for latching members 70 to key into during insertion of locking insert 60 into housing 30, and it is also preferred that a beveled surface 76 be provided on each latching member 70 to aid during insertion.

In another embodiment (not shown) the locking insert of the present invention may be inserted into the inter-cavity opening from the rear surface of a housing; in such an embodiment the rear section of the housing will comprise a single large opening instead of individual rear sections of terminal-receiving cavities. This would be useful, for instance, where is it desired to maintain the housing containing one set of terminal contacts, in mated engagement with another housing containing a mating set of terminal contacts, when only one terminal is desired to be replaced.

There are two distinct advantages to the use of the locking insert of the present invention with the housing having the expandable wall sections of the present invention: first, since the locking insert cannot be inserted until the terminals have been fully inserted and latchingly secured in their cavities and the expandable wall sections have returned to their unexpanded condition, it assures that all terminals are fully in place; second, the presence of the locking insert prevents the terminals from being unintentionally dislodged from the housing.

The present embodiments may be subject to many modifications and changes without departing from the spirit or essential characteristics of the present invention and are therefore to be considered in all respects as illustrative and not restrictive of the scope of the invention.

We claim:

1. An electrical connector for contact terminals comprising a connector housing including one or more terminal-receiving cavities extending axially therethrough in axial communication with front and rear surfaces thereof, each said cavity having at least a forward section in which a contact portion of a said terminal is secured after insertion of said terminal therein, said forward section of each said cavity having a rigid semicircular wall portion and a resilient, expandable semicircular wall portion joined to said rigid wall portion longitudinally therealong, there being terminal-engaging latching means on each of said rigid and said expandable wall portions such that when a respective said terminal having cooperating latching means thereon is inserted and before said terminal-engaging latching means and said cooperating latching means engage in a latching condition, said expandable semicircular wall portion of said cavity is expanded radially outwardly by said terminal, and upon said terminal being latched in said cavity said expandable wall portion returns to its normal unexpanded condition.

2. An electrical connector as set forth in claim 1 wherein said terminal-engaging latching means comprises chordal ledges on each of said rigid semicircular wall portion and said expandable semicircular wall portion, which ledges are on opposing sides of said cavity, and which chordal ledges have such configuration as to latchingly engage said cooperating latching means of a respective terminal.

3. An electrical connector as set forth in claim 1 wherein said housing includes one terminal-receiving cavity, and said housing further includes an extra-cavity opening extending from a surface of said housing along the said expandable wall portion of said cavity, said surface being axially normal to said cavity, said expandable wall portion being expandable into said extra-cavity opening.

4. An electrical connector as set forth in claim 1 wherein said expandable semicircular wall portion comprises two arcuate arm-like wall sections having a separation between free ends thereof, each of which arm-like wall sections is joined to said rigid semicircular wall portion longitudinally therealong, thus forming a cylindrical cavity.

5. An electrical connector as set forth in claim 4 wherein said housing includes a plurality of terminal-receiving cavities and further includes an inter-cavity opening extending from a surface of said housing axially normal to said cavities, between and along wall portions of forward sections of said cavities, and said arm-like wall sections are situated such that upon insertion of terminals into said cavities said arm-like wall sections are expanded into said inter-cavity opening.

6. An electrical connector as set forth in claim 1 wherein said housing includes a plurality of terminal-receiving cavities.

7. An electrical connector as set forth in claim 6 wherein said housing includes an inter-cavity opening extending from a surface of said housing between wall portions of said cavities, said surface being axially normal to said cavities.

8. An electrical connector as set forth in claim 7 wherein said expandable semicircular wall portions of said cavities are situated such that upon insertion of terminals thereinto and prior to latchingly securing said terminals therewithin, said expandable wall portions expand into said inter-cavity opening.

9. A locking insert for a housing of an electrical connector, having one or more terminal-receiving cavities therein each having a rigid semicircular wall portion and an expandable semicircular wall portion, which housing has an opening extending from a rear surface of said housing, along said expandable wall portion of each said cavity, said locking insert being insertable from said rear surface of said housing after a terminal has been latchingly secured in each said cavity, and said locking insert having a cross-sectional configuration conforming sufficiently to the cross-sectional shape of said opening to prevent said expandable wall portion of each cavity from being expanded.

10. A locking insert as set forth in claim 9 further including latching means for being latchingly engaged with said housing after insertion of said insert into said opening of said housing.

11. An assembly of a connector housing of an electrical connector and a locking insert therefor, said housing including one or more terminal-receiving cavities extending axially therethrough in axial communication with front and rear surfaces thereof;

each said cavity having at least a forward section in which a contact portion of a contact terminal is secured after insertion of said terminal therein, said forward section of each said cavity having a rigid semicircular wall portion and a resilient, expandable semicircular wall portion joined thereto longitudinally therealong;

terminal-engaging latching means on each of said rigid semicircular wall portion and said resilient expandable semicircular wall portion such that when a respective said terminal having cooperating latching means thereon is inserted into a said cavity and before said terminal-engaging latching means and said cooperating latching means engage in a latching condition, said expandable semicircular wall portion of said cavity is expanded radially outwardly by said terminal, and upon said terminal being latched in said cavity said expandable wall portion returns to its normal unexpanded condition;

an opening in said housing extending from a surface of said housing along wall portions of said forward section of each said cavity, said surface being axially normal to said cavity; and said locking insert being insertable into said opening from said surface of said housing after each said terminal has been latchingly secured in a said respective cavity, and having a cross-sectional configuration conforming sufficiently to the cross-sectional shape of said opening to prevent said expandable wall portion of each said cavity from being expanded.

12. An assembly as set forth in claim 11 wherein said housing includes a plurality of terminal-receiving cavities and said opening is an inter-cavity opening extending between said cavities and along said expandable wall portions of said cavities.

13. An assembly as set forth in claim 11 wherein said housing include one terminal-receiving cavity, and said opening is an extra-cavity opening extending along said expandable wall portion of said cavity.

14. An assembly as set forth in claim 11 wherein said locking insert is insertable from said front surface of said housing.

15. An assembly as set forth in claim 11 wherein said locking insert is insertable from said rear surface of said housing.

16. An assembly as set forth in claim 11 wherein said expandable semicircular wall portion of each said cavity comprises two arcuate arm-like wall sections having a separation between free ends thereof, each of which arm-like wall sections is joined to said rigid semicircular wall portion longitudinally therealong, thus forming a cylindrical cavity.

17. An assembly as set forth in claim 11 wherein said terminal-engaging latching means comprises chordal ledges on each of said rigid semicircular wall portion and said expandable semicircular wall portion of each said cavity, which ledges are on opposing sides of said cavity, and which chordal ledges have such configuration as to latchingly engage said cooperating latching means of a respective terminal.

18. An assembly as set forth in claim 11 wherein said locking insert includes latching means and said housing includes cooperating latching means such that upon insertion of said locking insert into said inter-cavity opening of said housing, said locking insert is latchingly secured in said housing.

19. An assembly as set forth in claim 18 wherein said locking insert is removable from said housing.

* * * * *